United States Patent [19]

Heimlicher

[11] 4,218,053

[45] Aug. 19, 1980

[54] FOLDING APPARATUS FOR FOUR OR SIX ETCHINGS

[75] Inventor: Paul Heimlicher, Lugnorre, Switzerland

[73] Assignee: Maschinenfabrik Wifag, Switzerland

[21] Appl. No.: 939,226

[22] Filed: Sep. 5, 1978

[30] Foreign Application Priority Data

Sep. 22, 1977 [SE] Sweden ..... 7710645

[51] Int. Cl.[2] ..... B65H 45/16

[52] U.S. Cl. ..... 270/71

[58] Field of Search ..... 270/8–11, 270/42, 48, 49, 70–72, 74–75

[56] References Cited

U.S. PATENT DOCUMENTS

| | | | |
|---|---|---|---|
| 2,306,248 | 12/1942 | Zuckerman | 270/6 |
| 2,706,628 | 4/1955 | Huck | 270/72 |

*Primary Examiner*—Edgar S. Burr
*Assistant Examiner*—A. J. Heinz
*Attorney, Agent, or Firm*—McGlew and Tuttle

[57] ABSTRACT

In a folding apparatus for a rotary printing press having a form cylinder with four or six etchings, with a folding cylinder having a plurality of spaced fastening devices on the circumference thereof and a collecting cylinder associated with the folding cylinder with folding blades, grippers or point group cassettes thereon, the improvement comprising, the fastening devices being divided into two groups, each with a number of fastening devices, with the ratio of the number of the fastening devices in each group being a mixed number. Each fastening device is provided with a cam follower and a cam wheel is positioned within the folding cylinder with cams thereon for selectively rendering the folding devices of one of the groups inoperative.

8 Claims, 2 Drawing Figures

FOLDING APPARATUS FOR FOUR OR SIX ETCHINGS

FIELD AND BACKGROUND OF THE INVENTION

This invention relates to folding apparatus in general and, in particular, to a new and useful folding apparatus for rotary printing presses whose form cylinder has, selectively, four or six etchings, with folding cylinders with fastening devices to receive a folding blade mounted to the circumference thereof, gripper or needle group cassettes, folding jaw cassettes or the like in two different numbers of a mixed number ratio to each other, and including a cutting device and an accelerating device.

U.S. Pat. application Ser. No. 822,923, now abandoned, hereby incorporated by reference, discloses the manner in which a folding jaw cylinder must be designed in order to attain favorable folding conditions, if it is intended to work with four or six etchings on the form cylinder circumference. The premise there is that fastening means for receiving folding jaw cassettes on each folding roller are provided in two different numbers having no integral ratio to each other. One group of folding jaw cassettes only is mounted at any one time and blanks are inserted in the fastening means remaining free. Perfect operation can be achieved with this solution. However, exchanging the folding jaw cassettes for blank inserts requires a relatively long time.

U.S. Pat. application Ser. No. 822,923 also mentions that the cutting device is alternately equipped with one or two cutting blades and that the drive system is adjusted accordingly through a step-up gear. This is also not an optimal solution.

SUMMARY OF THE INVENTION

It is an object of the present invention to create a folding apparatus which can be switched more simply from a four to a six etching mode.

The problem posed is solved in that all of the fastening means of the flap cylinder are provided with folding jaws accommodated in folding jaw cassettes and in that there are means by which the one or the other folding jaw group can be made inoperative alternately. The cutting cylinders and the accelerating rollers are each formed of different diameters and slots are provided to seat cutting blades, bars or fillers, and accelerating strips or fillers, respectively, are provided on the circumference of the rollers with uniform, mutually matched spacing.

The invention represents a further development of U.S. Pat. application Ser. No. 822,923 and is depicted in the drawing in one embodiment.

Accordingly, an object of the present invention is to provide a folding apparatus for a rotary printing press having a form cylinder with four or six etchings, with a folding cylinder having a plurality of spaced fastening devices on the circumference thereof and a collecting cylinder associated with the form cylinder with folding blades, gripper or needle group cassettes thereon, the improvement comprising: the fastening devices being divided into two groups, each with a number of fastening devices, the ratio of the number of fasten-devices in each group being a mixed number, and means provided in the folding cylinder for selectively rendering the folding devices of one of said groups inoperative.

A further object of the invention is to provide a folding apparatus as defined above which further includes a pair of cutting cylinders and a pair of accelerating cylinders, the diameters of each cutting cylinder and accelerating cylinder in each pair being different from each other, respectively, one of said pair of said cutting cylinders including a plurality of cutting bars equally circumferentially spaced thereon and the other of said cutting cylinders including a plurality of equally circumferentially spaced fillers which are spaced equally to the circumferential spacing of said cutting bars on the other of said cutting cylinders, one of said fillers including a cutting blade, one of said pair of accelerating devices including a plurality of equally circumferentially spaced accelerating strips, the other of said pair of accelerating cylinders including a plurality of equally circumferentially spaced fillers of a circumferential spacing equal to that of said accelerating strips on the other of said accelerating cylinder, one of said fillers including an accelerating strip engageable with an accelerating strip on the other of said cylinders.

Another object of the invention is to provide a folding apparatus for four or six etchings which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
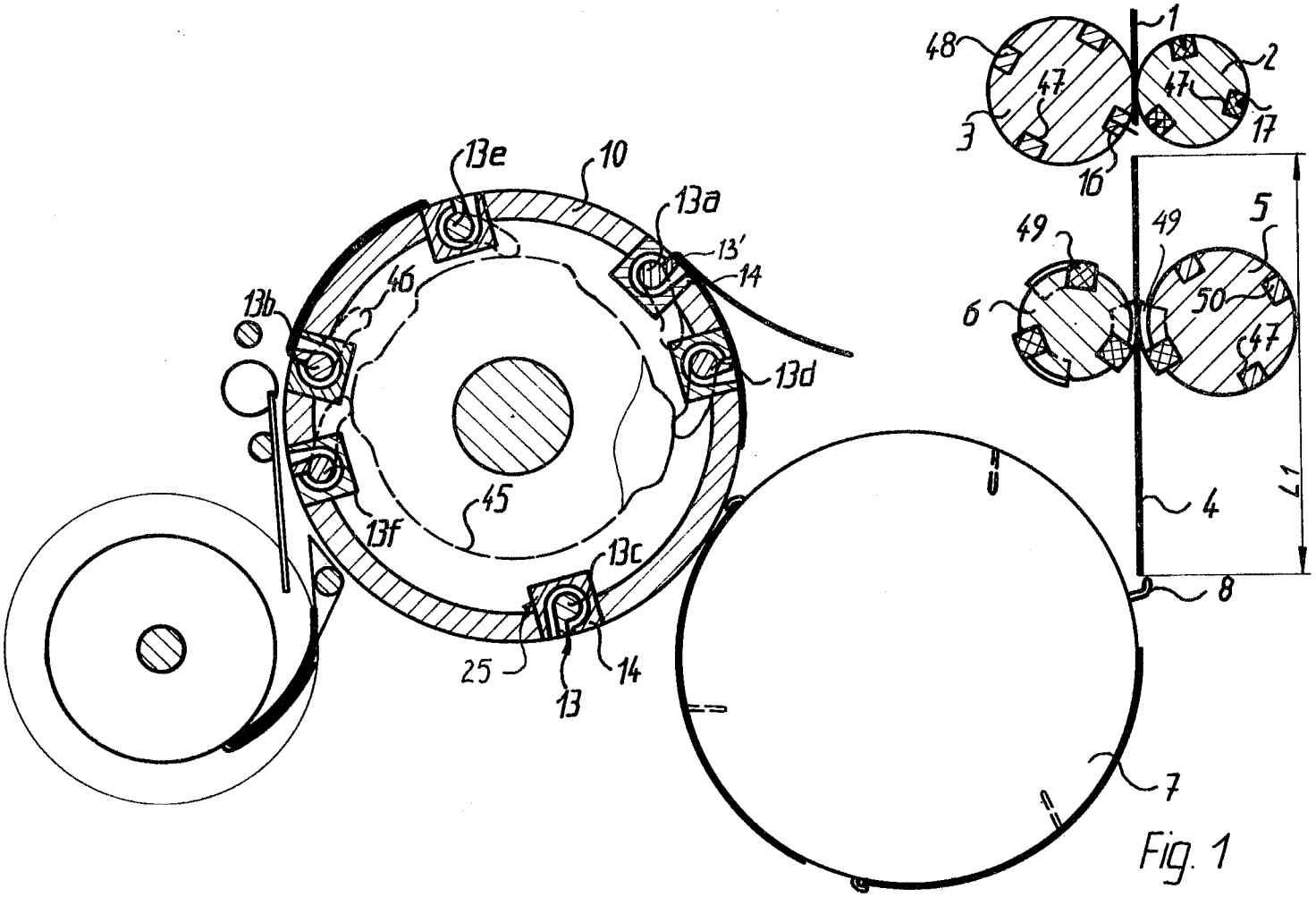
FIG. 1 is a schematic side elevational view of the invention showing the conditions for the invention when there are four etchings on a form cylinder which are disposed on its circumference, that is, for large size copies.

Referring to the drawings in particular, the invention embodied therein in FIG. 1, comprises, a folding apparatus for a rotary printing press having a form cylinder (not shown) with four or six etchings, with a folding cylinder 10 having a plurality of spaced fastening devices 13 on the circumference thereof and a collecting cylinder 7 associated with the folding cylinder with folding blades, gripper and needle group cassettes thereon, with one gripper being shown at 8. The fastening devices 13 are divided into two groups, 13*a*, 13*b* and 13*c*, and group 13*c*, 13*d*, 13*e* and 13*f*.

The ratio of the number of fastening devices in each group is a mixed number, forexample, in FIG. 1, the number of fastening devices in the first group is three and the number of fastening devices in the second group is four. The ratio of 3 to 4 is, of course, a mixed number, that is, not an integer.

Each fastening device may comprise a folding jaw 13' which rotates with respect to a housing 14. Each folding jaw 13' is connected to a cam follower or lever 46 which is engageable with a cam plate 45. Cam plate 45 includes a number of spaced cam surfaces for selectively engaging with the cam followers of the fastening devices in one group and rendering them inoperative. The devices for activating the jaw 13' with respect to the housing 14 is known per se.

The paper web 1 coming from the printing press is cut in a known manner by the cutting device 2, 3, into copies 4, which are accelerated by the accelerating device 5, 6 to the circumferential speed of the collecting cylinder 7 and transferred to the latter, i.e., retained at the leading ends, by the gripper groups 8. The cutting cylinders 2 and 3 as well as the accelerating rollers 5 and 6 are of different diameters, respectively, and are provided with slots 47 to receive cutting blades 16, bars 17 or fillers 48, or accelerating strips 49 or fillers 50, respectively.

The large cutting cylinder 3 in FIG. 1 is provided with a cutting blade 16 and three fillers 48, whereas, the small cutting cylinder 2, acting as a counter-cylinder, carries three bars 17. The number of slots 47 are selected with respect to the diameters of the two cutting cylinders 2 and 3 so that the circumferential arc distance between the slots 47 is the same on both cylinders.

The paper web 1 is thus cut with every revolution of the large cutting cylinder 3. Accordingly, copies of a length L are made which correspond to four etchings on the form cylinder circumference (not shown).

In order to accelerate this length of copy paper synchronously, the large accelerating roller 5 is equipped with one accelerating strip 49 and three fillers 50, and the small accelerating roller 6 with three accelerating strips 49. This means that a copy is picked up only when two accelerating strips come together, i.e., with every single revolution of the large accelerating roller 5.

Figure 2:
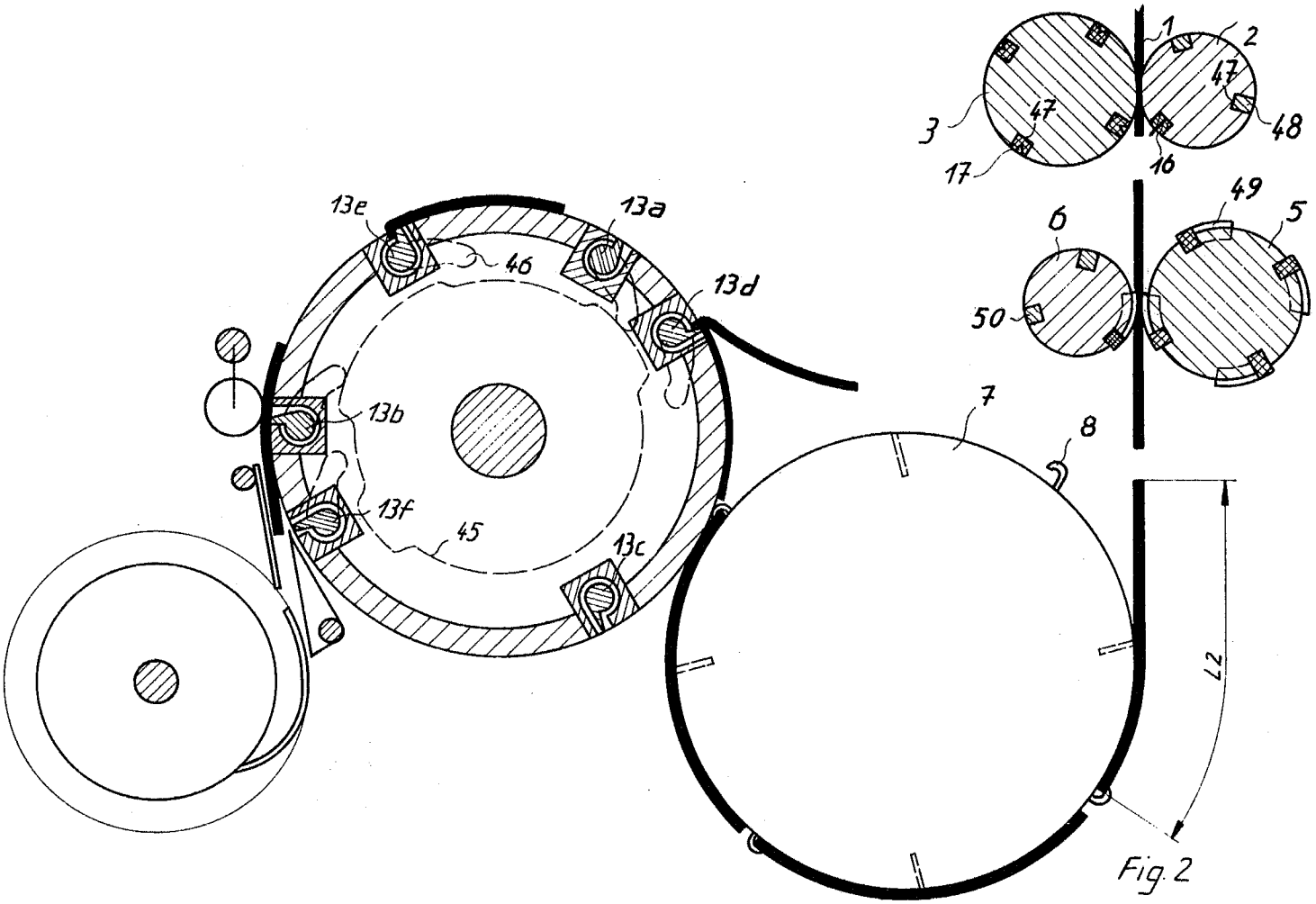
FIG. 2 is a view similar to FIG. 1 of the conditions for six etchings on a form cylinder circumference, that is, for small sized copies.

According to FIG. 2, the paper web 1 must be cut into copies of the length $L_2$, corresponding to six etchings on the form cylinder circumference (not shown). For this purpose, one cutting blade 16 and two fillers 48 are fastened in the small cutting cylinder 2, and four bars 17 in the large cutting cylinder 3, which is used here as a counter-cylinder. Consequently, the large accelerating roller 5 receives four accelerating strips 49 and the small accelerating roller 6 receives one accelerating strip 49 and two fillers 50. The paper web 1 is now cut with each revolution of the small cutting cylinder 2, and the copies are accordingly picked up with every revolution of the small accelerating roller 6.

The folding jaw group comprising jaws or fastening devices **13*a*, 13*b* and 13*c* in FIG. 1 is in action, whereas, the folding jaw group of jaws 13*d*, 13*e* and 13*f* are blocked by the action of a cam plate 45 via levers 46, for instance, in a closed position. The three folding jaws 13*a* to 13*c* in action are controlled by a cam control, known per se and not shown in detail. In operation, collecting cylinder 7 rotates to bring copies 4 into the range of the folding cylinder 10. Folding blades or the like on the collecting cylinder, intermediate the grippers 8, push each copy 4 overlying the blade into communication with a folding jaw which is not blocked as described. The folding jaws engage each copy 4 which are then moved by the rotation of the folding cylinder 10**.

In FIG. 2, the folding flap group **13*c*, 13*d*, 13*e* and 13*f* is in action, while the folding flaps 13*a*, 13*b* are blocked by the cam plate 45 via levers 46**.

The transfer of the blocking action from the folding flaps **13*d* to 13*f* to the folding flaps 13*a* and 13*b* is accomplished by turning the cam plate 45 relative to the folding flap cylinder 10** by means known per se which have not been shown.

It is of advantage but not a condition of the invention for the fastening devices 25 to be disposed in the folding flap cylinder 10 so that a folding flap of the one folding flap group coincides with a folding flap of the other folding flap group. This case is shown in the embodiment example and concerns the folding flap **13*c*. It is, therefore, always in operation and, for this reason, is not provided with a lever 46**.

While a specific embodiment of the invention has been shown and described in detail to illustrate the application of the principles of the invention, it will be understood that the invention may be embodied otherwise without departing from such principles.

What is claimed is:

1. In a folding apparatus for a rotary printing press having a form cylinder with four or six etchings, a folding cylinder having a plurality of spaced folding jaw devices on the circumferences thereof, a collecting cylinder having folding blades cooperating with the devices on the folding cylinder, said devices operating to grip a portion of a piece of sheet material to form a fold therein, the improvement comprising, said devices divided into two groups, each group having respective different numbers of said devices and the ratio of the number of said devices in one group relative to the number of devices in the other group being a mixed number, and means provided in the folding cylinder for alternately rendering said devices of one group inoperative while operating the devices of said other group.

2. In a folding apparatus for a rotary printing press, the improvement claimed in claim 1, further including a pair of cutting cylinders, each with a different diameter and a pair of accelerating cylinders, each with a different diameter, a plurality of equally circumferentially spaced cutting bars disposed on one of said cutting cylinders, the other of said cutting cylinders including a plurality of equally circumferentially spaced fillers having a circumferential spacing equal to that of said cutting bars, one of said fillers including a cutting bar, one of said accelerating cylinders including a plurality of equally circumferentially spaced accelerating strips, the other of said accelerating cylinders including a plurality of equally circumferentially spaced fillers having a circumferential spacing equal to that of said accelerating strips on said first-mentioned accelerating cylinder, and one of said fillers including an accelerating strip.

3. In a folding apparatus for a rotary printing press, the improvement claimed in claim 2, wherein one of said cutting and accelerating cylinders is substantially equal in diameter and the other of said cutting and accelerating cylinders is substantially equal in diameter, said first-mentioned one of said cutting and accelerating cylinders being smaller than said second mentioned cutting and accelerating cylinders, the smaller of said cutting and accelerating cylinders including three fillers, respectively, and the larger of said cutting and accelerating cylinders including four cutting bars and accelerating strips, respectively.

4. In a folding apparatus for a rotary printing press, the improvement claimed in claim 1, wherein each of said devices comprises a fastening jaw in a fastening jaw housing, each of said fastening jaws including a cam follower, a cam plate rotatably mounted within said folding cylinder having a plurality of cam surfaces selectively engageable with the cam followers of said devices in one of said groups.

5. In a folding apparatus for a rotary printing press, the improvement claimed in claim 4, wherein one of the devices of the folding cylinder is common to both of said groups.

6. In a folding apparatus for a rotary printing press, the improvement claimed in claim 5, further including a pair of cutting cylinders, each with a different diameter and a pair of accelerating cylinders, each with a different diameter, a plurality of equally circumferentially spaced cutting bars disposed on one of said cutting cylinders, the other of said cutting cylinders including a plurality of equally circumferentially spaced fillers having a circumferential spacing equal to that of said cutting bars, one of said fillers including a cutting bar, one of said accelerating cylinders including a plurality of equally circumferentially spaced accelerating strips, the other of said accelerating cylinders including a plurality of equally circumferentially spaced fillers having a circumferential spacing equal to that of said accelerating strips on said first-mentioned accelerating cylinder, and one of said fillers including an accelerating strip, wherein one of said cutting and accelerating cylinders is substantially equal in diameter and the other of said cutting and accelerating cylinders is substantially equal in diameter, said first-mentioned one of said cutting and accelerating cylinders being smaller than said second mentioned cutting and accelerating cylinders, the smaller of said cutting and accelerating cylinders including three fillers, respectively, and the larger of said cutting and accelerating cylinders including four cutting bars and accelerating strips, respectively.

7. In a folding apparatus for a rotary printing press, the improvement claimed in claim 1, wherein the number of said devices in one of said groups is four and the number of said devices in the other of said groups is three.

8. In a folding apparatus for rotary printing presses having a form cylinder with, selectively, four or six etchings and a folding cylinder having on its circumference a plurality of folding jaw devices, a collecting cylinder having folding blades cooperating with the devices on the folding cylinder, said devices operating to grip a portion of a piece of sheet material to form a fold therein, gripper groups, and needle group cassettes, the improvement comprising, in combination, said devices being provided in two groups on the folding cylinder, with the two groups including respective different numbers of said devices, and the devices of each group being spaced at equal angular intervals from each other on the folding cylinder, the ratio of the number of said devices in one group to the number of said devices in the other group being a mixed number, and means for alternately blocking one group to prevent gripping of a piece of sheet material by the devices of that group while continuing to operate the devices of the other group.

* * * * *